US009702179B2

(12) United States Patent
Shimizu et al.

(10) Patent No.: US 9,702,179 B2
(45) Date of Patent: Jul. 11, 2017

(54) CLOSER DEVICE AND VEHICLE DOOR LOCKING DEVICE

(71) Applicant: AISIN SEIKI KABUSHIKI KAISHA, Kariya-shi, Aichi-ken (JP)

(72) Inventors: Kimito Shimizu, Anjo (JP); Takeshi Kuwabara, Gifu (JP)

(73) Assignee: AISIN SEIKI KABUSHIKI KAISHA, Aichi-Ken, Kariya-Shi (JP)

( * ) Notice: Subject to any disclaimer, the term of this patent is extended or adjusted under 35 U.S.C. 154(b) by 0 days.

(21) Appl. No.: 14/951,898

(22) Filed: Nov. 25, 2015

(65) Prior Publication Data

US 2016/0145928 A1 May 26, 2016

(30) Foreign Application Priority Data

Nov. 26, 2014 (JP) ..... 2014-239004
Nov. 26, 2014 (JP) ..... 2014-239005
Nov. 26, 2014 (JP) ..... 2014-239006

(51) Int. Cl.

| | |
|---|---|
| ***E05B 81/20*** | (2014.01) |
| ***E05F 15/611*** | (2015.01) |
| ***E05C 3/12*** | (2006.01) |
| ***E05B 81/06*** | (2014.01) |
| ***E05B 81/24*** | (2014.01) |
| ***E05B 77/32*** | (2014.01) |
| ***E05B 81/64*** | (2014.01) |

(52) U.S. Cl.

CPC ..... *E05F 15/611* (2015.01); *E05B 77/32* (2013.01); *E05B 81/06* (2013.01); *E05B 81/20* (2013.01); *E05B 81/25* (2013.01); *E05B 81/64* (2013.01); *E05C 3/12* (2013.01)

(58) Field of Classification Search

CPC ..... E05F 15/611; E05B 77/32; E05B 81/00; E05B 81/04; E05B 81/06; E05B 81/20; E05B 81/25; E05B 81/64; E05C 3/12

USPC ..... 292/1, 201, 216, 280

See application file for complete search history.

(56) References Cited

U.S. PATENT DOCUMENTS 5,441,315 A * 8/1995 Kleefeldt ..... E05B 81/25 292/144
2010/0194122 A1* 8/2010 Akizuki ..... E05B 81/20 292/216
2013/0033045 A1* 2/2013 Worm ..... E05B 65/0075 292/5

FOREIGN PATENT DOCUMENTS

JP 2007-138533 A 6/2007

* cited by examiner

*Primary Examiner* — James O Hansen

(74) *Attorney, Agent, or Firm* — Buchanan Ingersoll & Rooney PC

(57) ABSTRACT

A closer device includes: a threaded shaft rotating by drive force of a motor; a shaft-like member threadedly engaging with the threaded shaft to transmit decelerated rotation of the threaded shaft and permit displacement in an axial direction between a first axial position and a second axial position; and a restriction member displaced between a first position at which the shaft-like member is displaced from the side of the first axial position to the side of the second axial position by restricting rotation of the shaft-like member that accompanies the rotation of the threaded shaft and a second position at which the displacement of the shaft-like member from the side of the first axial position to the side of the second axial position is restricted by permitting the rotation of the shaft-like member that accompanies the rotation of the threaded shaft.

17 Claims, 7 Drawing Sheets

CLOSER DEVICE AND VEHICLE DOOR LOCKING DEVICE

CROSS REFERENCE TO RELATED APPLICATIONS

This application is based on and claims priority under 35 U.S.C. §119 to Japanese Patent Applications 2014-239004, 2014-239005 and 2014-239006, all filed on Nov. 26, 2014, the entire contents of which are incorporated herein by reference.

TECHNICAL FIELD

This disclosure relates to a closer device and a vehicle door locking device.

BACKGROUND DISCUSSION

In the related art, vehicle door locking devices for closing vehicle doors in a half-shut state to a completely closed state are known. A vehicle door locking device disclosed in JP2007-138533A (Reference 1) has a latch that is rotated and displaced, and the device is provided with a latch mechanism that switches opened and closed states of a vehicle door by cooperation between the latch and a striker provided at a vehicle body, and a door closer device that transmits drive force of a motor to the latch mechanism in order to rotate and displace the latch and causes the latch to perform an operation of closing the vehicle door. The latch mechanism is coupled to a door lever and the latch is rotated and displaced from a position at which disengagement of the striker is not permitted to a position at which the disengagement is permitted, in response to pulling of the door lever. In doing so, the vehicle door can be opened.

Incidentally, force of rotating and displacing the latch to the position at which the disengagement of the striker by the door closer device is not permitted and force of rotating and displacing the latch to the position at which the disengagement of the striker is permitted in response to the operation of the door lever are imparted on the latch if the door lever is pulled during the transmission of the drive force of the motor from the door closer device to the latch mechanism. In order to prevent such a state, the door closer device disclosed in Reference 1 is provided with a cancellation mechanism that prevents the drive force of the motor from being transmitted to the latch.

The cancellation mechanism mentioned in Reference 1 is provided with a cancellation gear that is displaced between a position at which the cancellation gear meshes with a ring gear in a planetary gear mechanism that forms a deceleration mechanism for decelerating rotation of the motor and restricts rotation of the ring gear and a position at which the cancellation gear does not mesh with the ring gear and permits the rotation of the ring gear. The cancellation gear generally meshes with the ring gear and restricts the rotation of the ring gear. Since the rotation of the ring gear is restricted, decelerated rotation of the motor is transmitted to a sun gear that forms the planetary gear mechanism. The cancellation gear is displaced from the position at which the cancellation gear meshes with the ring gear to the position at which the cancellation gear does not mesh with the ring gear in response to the operation of the door lever. In response to the operation, the rotation of the ring gear is permitted, and the rotation of the motor is not transmitted to the sun gear.

Incidentally, such a vehicle door locking device is provided inside a vehicle door. Since various configurations including a window glass are provided inside the vehicle door, there is a problem that the door closer device that employs a planetary gear mechanism as a deceleration mechanism has a large scale as a whole and it is difficult to mount other configurations.

SUMMARY

Thus, a need exists for a small-scaled closer device and a vehicle door locking device.

A closer device according to an aspect of this disclosure includes: a threaded shaft that rotates by drive force of a motor; a shaft-like member that threadedly engages with the threaded shaft to transmit decelerated rotation of the threaded shaft and permit displacement in an axial direction between a first axial position and a second axial position; and a restriction member that is displaced between a first position at which the shaft-like member is displaced from the side of the first axial position to the side of the second axial position by restricting rotation of the shaft-like member that accompanies the rotation of the threaded shaft and a second position at which the displacement of the shaft-like member from the side of the first axial position to the side of the second axial position is restricted by permitting the rotation of the shaft-like member that accompanies the rotation of the threaded shaft, in which the shaft-like member drives a locking member of a latch mechanism by being displaced from the first axial position to the second axial position, and in which the restriction member is displaced from the first position to the second position in conjunction with an operation unit that is operated by a user.

BRIEF DESCRIPTION OF THE DRAWINGS

The foregoing and additional features and characteristics of this disclosure will become more apparent from the following detailed description considered with the reference to the accompanying drawings, wherein:

FIG. 4A shows an unlatched state, FIG. 4B shows a half-latched state, and FIG. 4C shows a fully-latched state;

FIG. 6A shows a state in which rotation and displacement of a spindle guide are restricted and a spindle is at a first axial position, FIG. 6B shows a state in which the rotation and the displacement of the spindle guide are restricted and the spindle is at a second axial position, FIG. 6C shows a state in which the rotation and the displacement of the spindle guide are permitted and the spindle is at the second axial position, and FIG. 6D shows a state in which the rotation and the displacement of the spindle guide are permitted and the spindle is at the first axial position;

DETAILED DESCRIPTION

Hereinafter, a description will be given of an embodiment of a vehicle door locking device with reference to drawings.

Configuration of Vehicle Door Locking Device

Figure 1:
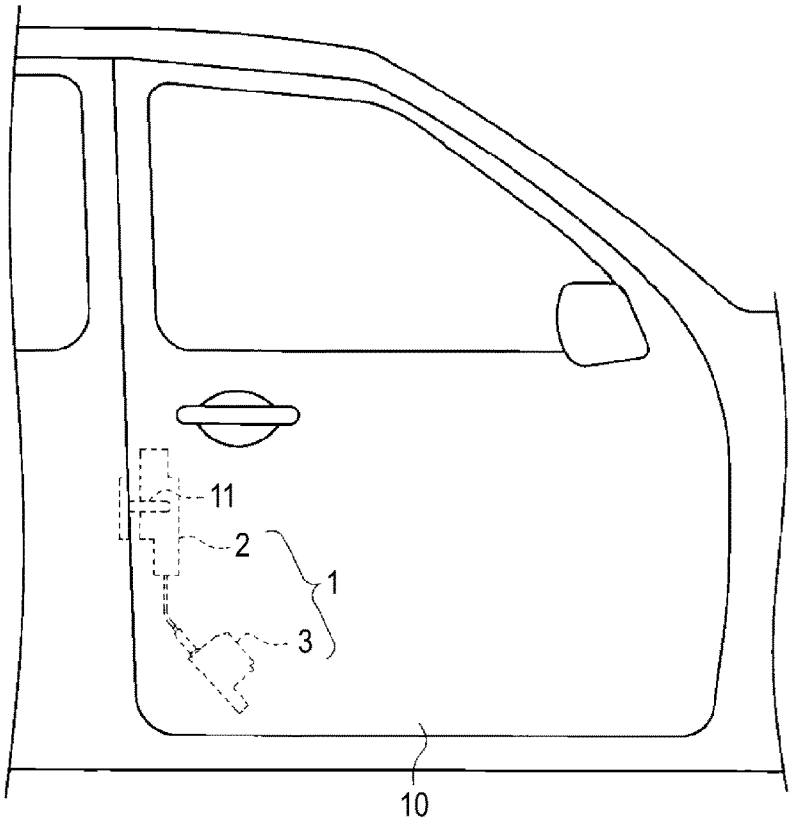
FIG. 1 is a side view of a vehicle door on which a closer device and a vehicle door locking device are mounted.
Figure 2:
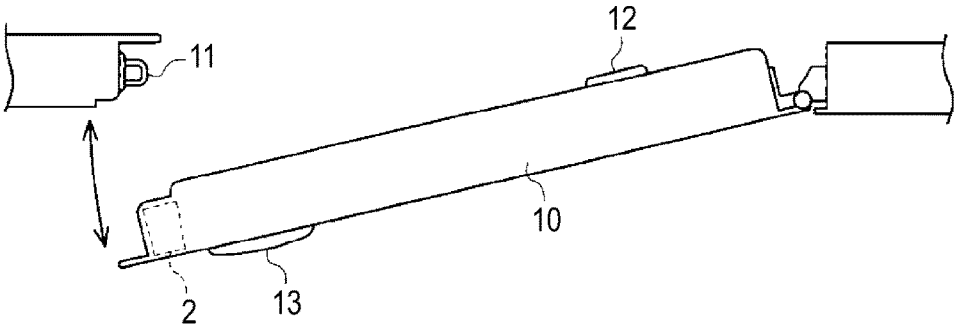
FIG. 2 is a top view of the vehicle door on which the closer device and the vehicle door locking device are mounted.

As shown in FIGS. 1 and 2, a vehicle door locking device 1 that is provided at a swing-type vehicle door 10 is provided with a latch mechanism 2 and a closer device 3.

The latch mechanism 2 is provided with a latch 21 (see FIG. 3) that is rotated and displaced, and switches opened and closed states of the vehicle door 10 by cooperation between a striker 11 and the latch 21 that are relatively moved in response to operations of opening and closing the vehicle door 10 as shown in FIG. 2.

The closer device 3 is provided with a motor 31 (see FIG. 5) and switches the latch mechanism 2 from a half-latched state in which relative movement of the striker 11 is permitted to a fully-latched state in which the relative movement of the striker 11 is not permitted by transmission of drive force of the motor 31 to the latch mechanism 2.

Latch Mechanism

Figure 3:
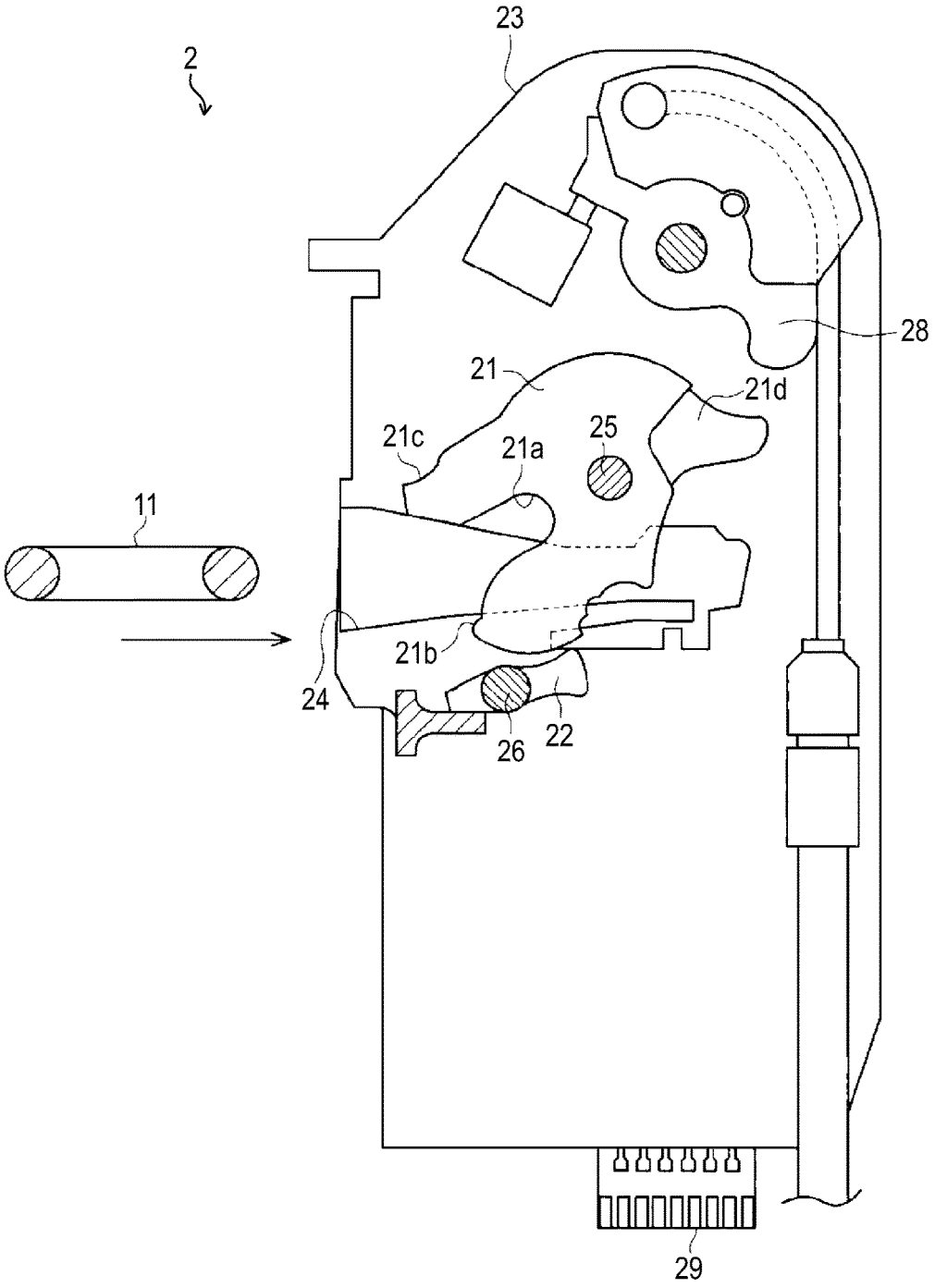
FIG. 3 is a side view of a latch mechanism.
Figure 4A:
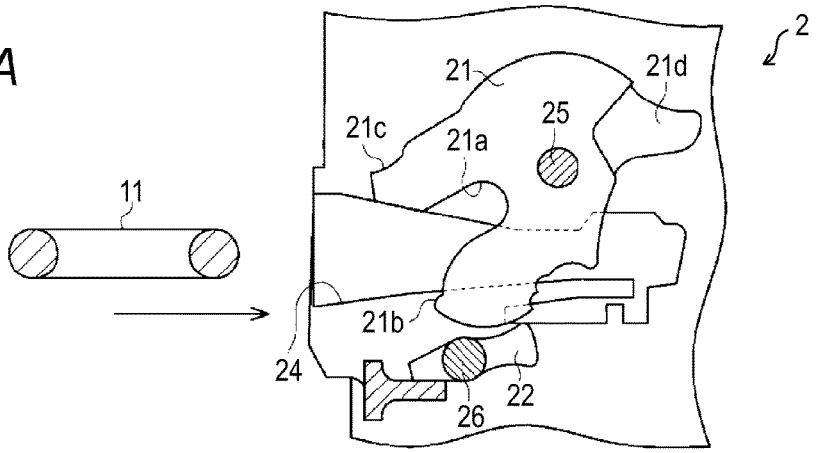
FIGS. 4A to 4C are side views of the latch mechanism, where
Figure 4B:
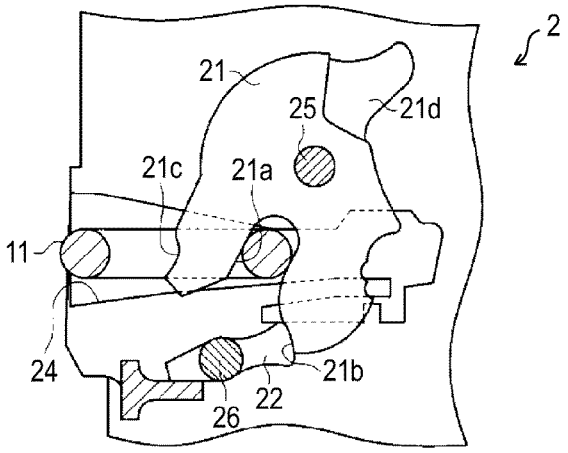
Figure 4C:
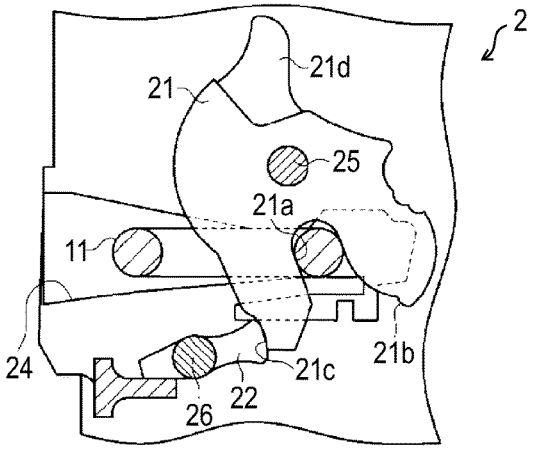

As shown in FIGS. 3 to 4C, the latch mechanism 2 is provided with the latch 21, a pole 22, and a case 23 that accommodates the latch 21 and the pole 22.

The case 23 is provided with a loading/unloading portion 24 that is formed by notching an outer surface in a slit shape. The loading/unloading portion 24 permits loading and unloading the striker 11 to and from the case 23 that accompanies the relative movement. In addition, two support shafts 25 and 26 are provided in the case 23 so as to stand with the loading/unloading portion 24 interposed therebetween in a groove width direction (vertical direction in FIG. 3). The two support shafts 25 and 26 can be rotated and displaced relative to the case 23. The latch 21 is fixed to the support shaft 25, and the pole 22 is fixed to the support shaft 26.

In addition, a lever 28 that is coupled to the closer device 3 via wire 27 is pivotally supported to the case 23 in a rotatable fashion. The lever 28 can be rotated and displaced in the clockwise direction from an initial position (the position illustrated in FIG. 3) at which the lever 28 does not engage with the latch 21 in response to driving of the closer device 3, be brought into engagement with the latch 21, and pressurizes the latch 21. The latch 21 is rotated and displaced in the counterclockwise direction in response to pressurization that accompanies the rotation and displacement of the lever 28 in the clockwise direction, as will be described later in detail.

The latch 21 with a plate shape is provided with an engagement groove 21*a* that opens in an outer circumferential surface thereof. The latch 21 is constantly biased by a latch bias spring, which is not shown in the drawings, so as to be rotated and displaced in the clockwise direction in the drawings. In addition, rotation and displacement of the latch 21 in the clockwise direction by the latch bias spring are restricted at a position, at which the loading/unloading portion 24 and an opening end of the engagement groove 21*a* coincide with each other (hereinafter, referred to as an unlatched position), by abutting on a stopper portion that is provided at the case 23 and is not shown in the drawings. Therefore, if a closing operation is performed on the vehicle door 10 in a state in which the latch 21 is at the unlatched position, the engagement groove 21*a* engages with the striker 11 that advances from the loading/unloading portion 24. Then, the engagement groove 21*a* is pressurized against the striker 11 by the striker 11 further advancing against the bias force of the latch bias spring (not shown), and the latch 21 is then rotated and displaced in the counterclockwise direction. The latch 21 is rotated and displaced from the unlatched position that is shown in FIGS. 3 and 4A to a fully-latched position that is shown in FIG. 4C through a half-latched position that is shown in FIG. 4B by being rotated and displaced in the counterclockwise direction against the bias force of the latch bias spring (not shown). The striker 11 is relatively drawn into the latch mechanism 2 by the latch mechanism 2 being switched from the half-latched state to the fully-latched state. In doing so, the vehicle door 10 shifts from the half shut state to the completely closed state.

As shown in FIGS. 3 to 4C, a first engagement portion 21*b* that is half-engaged with the pole 22 is provided when the latch 21 is at the half-latched position, and a second engagement portion 21*c* that is engaged with the pole 22 when the latch 21 is at the fully-latched position, in the outer circumferential surface of the latch 21. The rotation and the displacement of the latch 21 in the clockwise direction by the bias force of the latch bias spring (not shown) are restricted due to the half engagement between the latch 21 and the pole 22. In addition, the rotation and the displacement of the latch 21 in the clockwise direction are restricted due to the engagement between the latch 21 and the pole 22.

In addition, a third engagement portion 21*d* that can be engaged with the lever 28 that rotates in the clockwise direction when the latch 21 is positioned between the half-latched position and the fully-latched position is provided in the outer circumferential surface of the latch 21. The latch 21 that is positioned between the half-latched position and the fully-latched position is rotated and displaced in the counterclockwise direction up to the fully-latched position by being pressurized by the lever 28 that rotates in the clockwise direction via the third engagement portion 21*d*.

The pole 22 is constantly biased so as to be rotated and displaced in the counterclockwise direction by a pole bias spring that is not shown in the drawings. The pole 22 is maintained at a position (hereinafter, referred to as a restriction position) at which the pole can be engaged with the first engagement portion 21*b* and the second engagement portion 21*c* of the latch 21 by abutting on the stopper portion that is provided at the case 23.

In addition, the pole 22 is coupled to an inside door handle 12 and an outside door handle 13 (see FIG. 2), respectively, that are provided at the vehicle door 10 via a known mechanism that is not shown in the drawings. Therefore, the pole 22 is displaced from the restriction position to an open position at which the pole 22 cannot be engaged with the first engagement portion 21*b* and the second engagement portion 21*c* of the latch 21 by being rotated and displaced in the clockwise direction against the bias force of the pole bias spring (not shown) in response to an operation performed on either the inside door handle 12 or the outside door handle 13.

As shown in FIG. 3, the case 23 is produced by insert molding while various kinds of wiring are inserted. The case 23 is provided with various switches including a latch switch that detects a position of the latch 21, a pole switch that detects a position of the pole 22, and a lever switch that detects a position of the lever 28. Electrical connecting portions of these switches are concentrated on a single connector portion 29 via various kinds of inserted wiring. The connector portion 29 is provided in the vehicle and is connected, for example, to a control unit that controls driving of the door locking device 1 through a dedicated harness.

Closer Device

Figure 5:
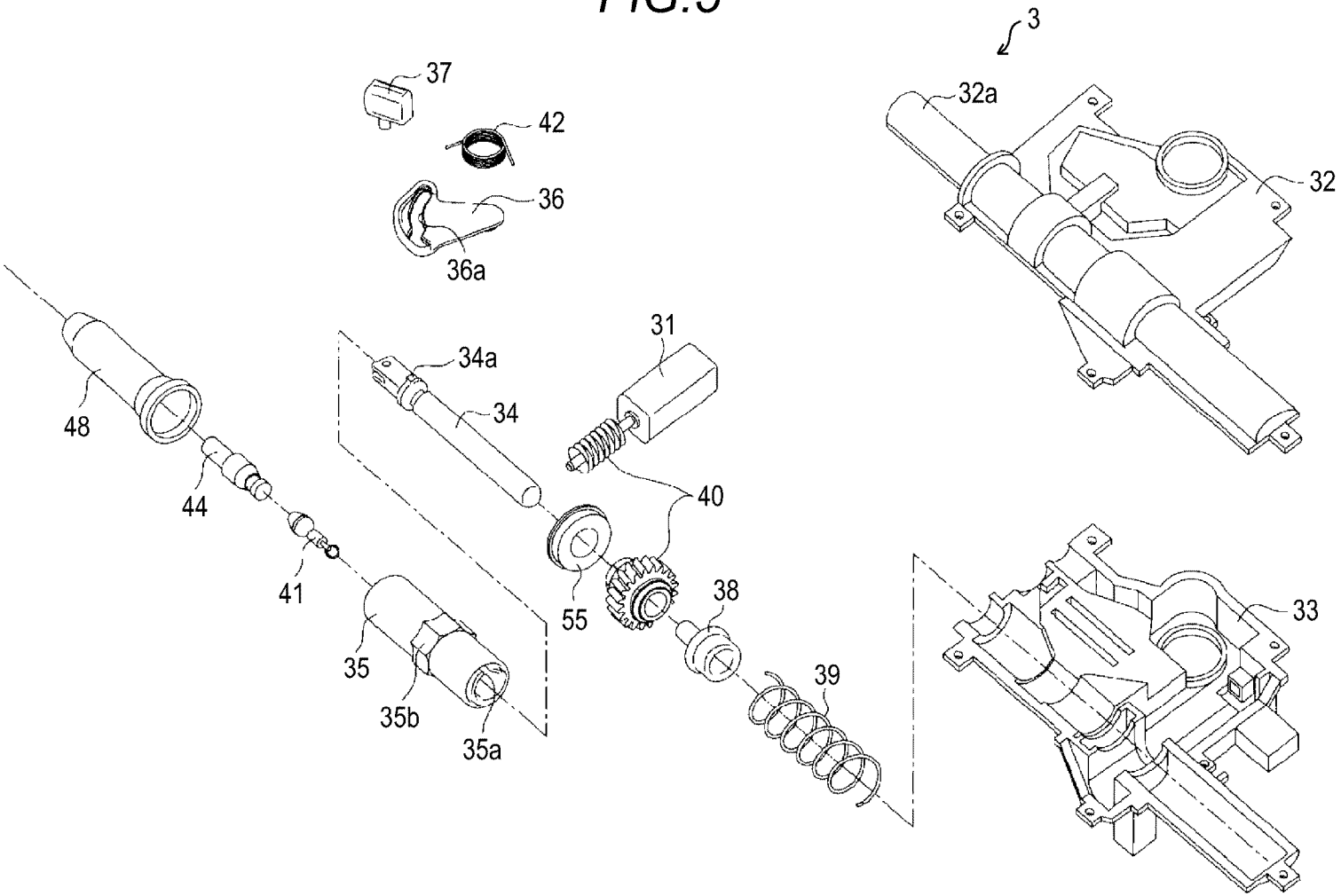
FIG. 5 is an exploded perspective view of the closer device.

As shown in FIG. 5, the closer device 3 is provided with a motor 31, a body 32, a housing 33, a spindle 34, a spindle guide 35, a cancellation lever 36, a cancellation pole 37, a cancellation collar 38, and a cancellation assist spring 39. These various configurations other than the body 32 and the housing 33 are accommodated in an inner space that is formed by attaching the body 32 and the housing 33 to each other. The body 32 and the housing 33 correspond to the case.

As shown in FIGS. 6A to 6D, the spindle 34 that is provided at a skew position relative to a motor shaft 31*a* of the motor 31 has a columnar shape and is threadedly inserted into a wheel that forms a worm wheel 40. The motor 31 is connected, for example, to a control unit that controls driving of the door locking device 1 via a dedicated harness.

Figure 8:
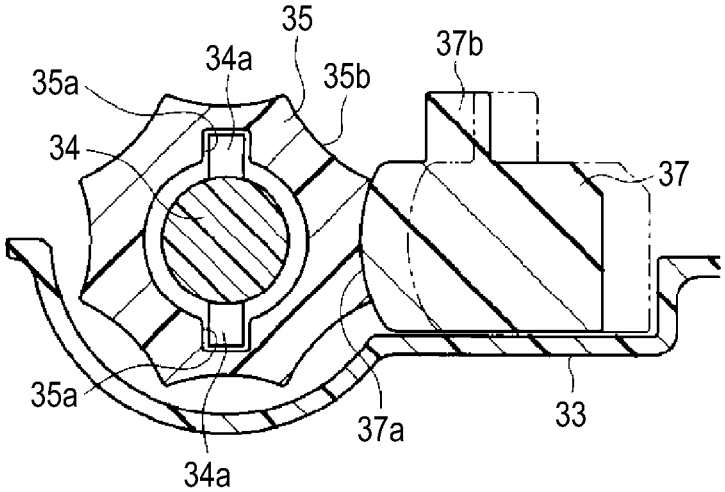
FIG. 8 is a sectional view of the closer device in a direction perpendicular to the axis of the spindle.

As shown in FIGS. 5 and 8, two rectangular parallelepiped projections 34*a* that have surfaces in parallel with the axial direction of the spindle 34 are provided at the spindle 34 so as to project from the outer circumferential portion on the side of the latch mechanism 2 beyond the portion at which the spindle is threadedly inserted into the wheel. The wheel of the worm wheel 40 corresponds to the threaded shaft, and the spindle 34 corresponds to the shaft-like member.

Figure 6A:
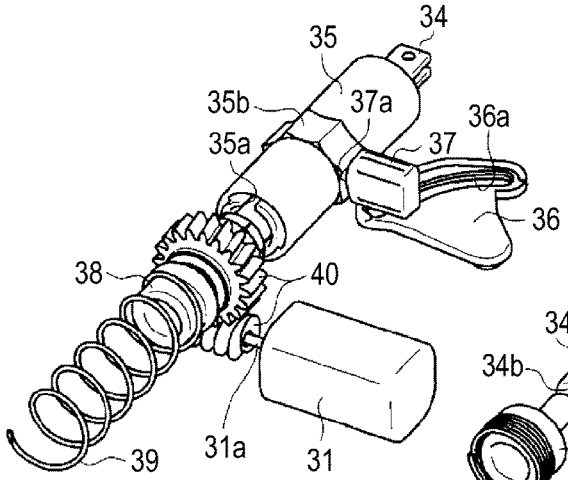
FIGS. 6A to 6D are perspective views of the closer device, where
Figure 6B:
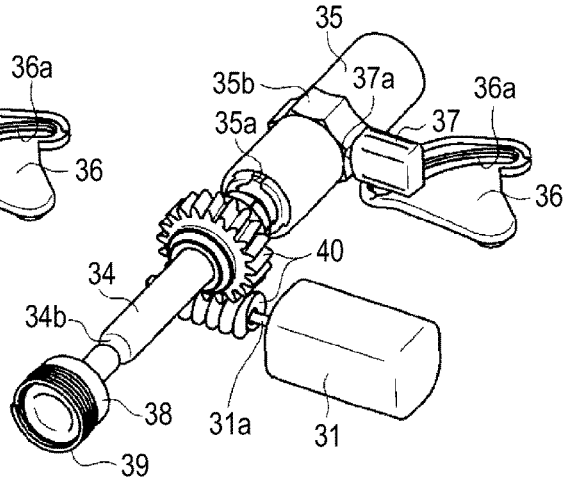
Figure 6C:
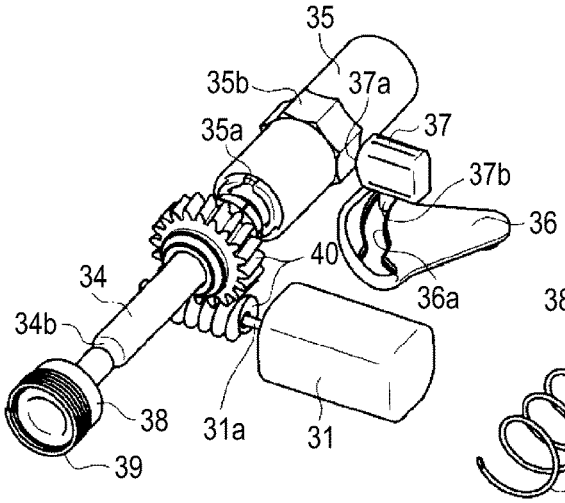
Figure 6D:
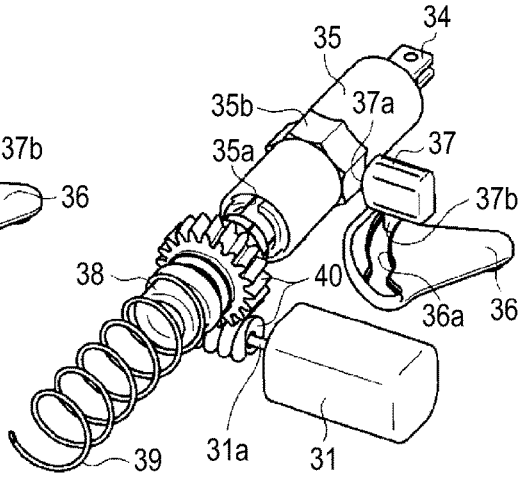

The spindle 34 can be displaced between a first axial position that is shown in FIGS. 6A and 6D and a second axial position on the opposite side of the latch mechanism 2 from the first axial position, which is shown in FIGS. 6B and 6C, (the side of the cancellation assist spring 39 that will be described later). The displacement of the spindle 34 from the side of the first axial position to the side of the second axial position is restricted by the projections 34*a* abutting on a reduced diameter portion 53, which will be described later, at the second axial position. The displacement of the spindle 34 from the side of the second axial position to the side of the first axial position is restricted by the projections 34*a* abutting on groove ends of guide grooves 35*a*, which will be described later, of the spindle guide 35 at the first axial position.

Figure 7:
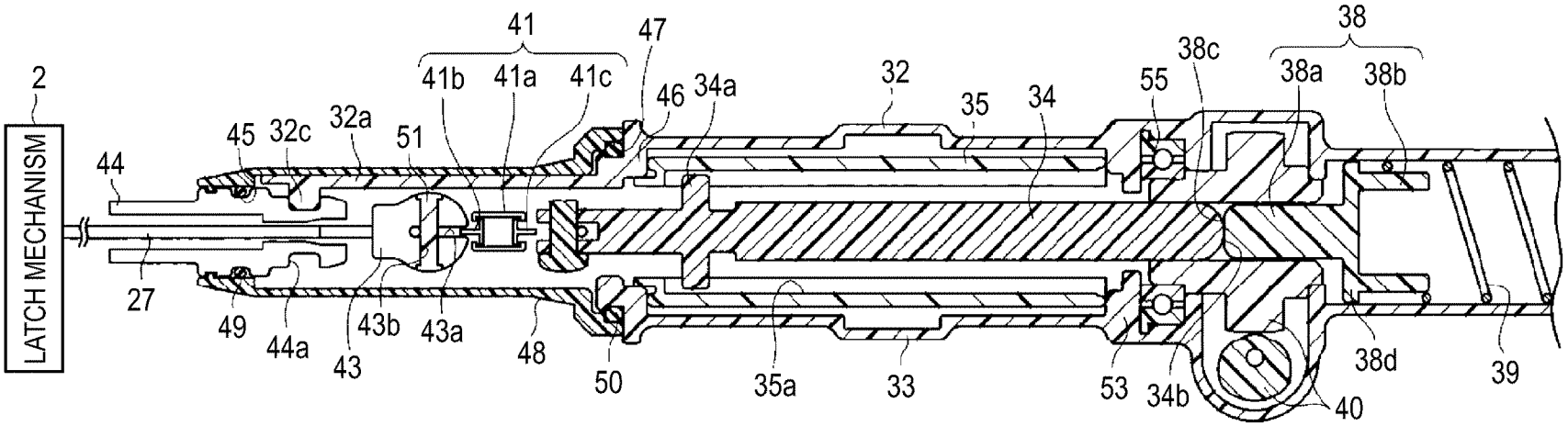
FIG. 7 is a sectional view of the closer device in the axial direction of the spindle.

As shown in FIGS. 5 and 7, a tip end of the spindle 34 on the opposite side to the latch mechanism 2, that is, a tip end 34*b* on the side of the portion that is threadedly inserted into the wheel beyond the projections 34*a* has a semi-spherical shape with an outer diameter that is gradually reduced toward the tip end. In contrast, a tip end of the spindle 34 on the side of the latch mechanism 2, that is, a tip end on the opposite side to the tip end 34*b* is connected to wire 27 (see FIG. 3) via the swivel 41. Detailed descriptions will be given of the swivel 41 and a connection structure between the swivel 41 and the wire 27. The wire 27 corresponds to the transmission member.

As shown in FIGS. 5 to 8, the spindle guide 35 has a cylindrical shape with an inner diameter that is slightly larger than an outer diameter of the spindle 34. As shown in FIG. 8, the two guide grooves 35*a* that extend in the axial direction of the spindle guide 35 are provided so as to be recessed in the inner circumferential surface of the spindle guide 35. The width of the guide grooves 35*a* is set to be slightly wider than the distance between surfaces of the projections 34*a* of the spindle 34, which are in parallel with the axial direction of the spindle 34. Therefore, the spindle 34 is inserted into the spindle guide 35 by matching the positions of the guide grooves 35*a* and the projections 34*a* in the circumferential direction of the spindle guide 35 and the spindle 34. Accordingly, displacement of the spindle 34 in the axial direction inside the spindle guide 35 is permitted, and the spindle 34 is integrally rotated with the spindle guide 35 in the circumferential direction.

As shown in FIGS. 5 to 8, the spindle guide 35 includes an engagement portion 35*b* with a substantially regular octagonal shape provided in an outer circumferential surface at the center in the axial direction. As shown in FIG. 8, each of eight surfaces that forms the engagement portion 35*b* is curved such that the center thereof is located closer to the axial center of the spindle guide 35 than ends thereof (boundaries with adjacent surfaces).

The spindle guide 35 corresponds to the tubular member and is accommodated in the inner space that is formed by the body 32 and the housing 33 in a state in which rotation about the axial direction is permitted and displacement in the axial direction is restricted. As shown in FIG. 7, an outer diameter of an end of the spindle guide 35 on the side of the latch mechanism 2 is set to be smaller than an outer diameter of an end on the other side. In addition, the inner space that is formed by attaching the body 32 and the housing 33 to each other and corresponds to a portion for accommodating the spindle guide 35 is set such that a space on the side of the latch mechanism 2 is narrower than a space on the other side.

As shown in FIGS. 5 to 8, the cancellation pole 37 with a plate shape includes a curved surface 37*a* that can be engaged with the engagement portion 35*b* of the spindle guide 35 and a columnar support shaft 37*b*. The cancellation pole 37 is displaced between a rotation restriction position at which the curved surface 37*a* abuts on (engages with) the engagement portion 35*b* of the spindle guide 35 and restricts the rotation of the spindle guide 35 and a rotation permission position at which the curved surface 37*a* is separated from the engagement portion 35*b* and permits the rotation of the spindle guide 35, by the columnar support shaft 37*b* being guided by a guide groove that is provided in the body 32 and is not shown in the drawings.

The distance between the support shaft 37*b* and the swing center of the cancellation lever 36, which will be described later, when the cancellation pole 37 is located at the rotation restriction position will be referred to as a first distance, and the distance between the support shaft 37*b* and the swing center of the cancellation lever 36 when the cancellation pole 37 is located at the rotation permission position will be referred to as a second position. The cancellation pole 37 corresponds to the restriction member. In addition, the curved surface 37*a* corresponds to the engagement surface.

As shown in FIGS. 5 to 8, the cancellation lever 36 with a fan shape is pivotally supported by the body 32 so as to be able to swing about a rivet of the fan. The cancellation lever 36 is displaced between a first position that is shown in FIGS. 6A and 6B and a second position on the side of the motor 31 beyond the first position as shown in FIGS. 6C and 6D by abutting on a stopper that is provided at the body 32 and is not shown in the drawings.

The cancellation lever 36 includes a guide groove 36*a* provided so as to follow the arc of the fan. The width of the guide groove 36*a* is set to be slightly wider than the outer diameter of the support shaft 37*b* of the cancellation pole 37. The support shaft 37*b* of the cancellation pole 37 is inserted into the guide groove 36*a*. In addition, the guide groove 36*a* is set such that the distance between an end thereof on the side of the motor 31 and the swing center is the first distance and the distance between an end thereof on the opposite side to the motor 31 and the swing center is the second distance. Therefore, the cancellation pole 37 is located at the rotation restriction position when the cancellation lever 36 is located at a first swing position, and the cancellation pole 37 is located at the rotation permission position when the cancellation lever 36 is located at a second swing position. In addition, the cancellation pole 37 is displaced between the rotation restriction position and the rotation permission position by the cancellation lever 36 swinging.

The cancellation lever 36 is constantly biased toward the clockwise direction in FIGS. 6A to 6D by a return spring 42 that is shown in FIG. 5. In doing so, the cancellation lever 36 is normally located at the first swing position as shown in FIGS. 6A and 6B. In addition, the cancellation lever 36 is coupled to the inside door handle 12 and the outside door handle 13 (see FIG. 2), respectively, that are provided at the vehicle door 10 via a known mechanism that is not shown in the drawings. In doing so, the cancellation lever 36 swings toward the counterclockwise direction in FIGS. 6A to 6D and is then displaced from the first swing position to the second swing position in response to an operation performed on either the inside door handle 12 or the outside door handle 13.

As shown in FIGS. 5 to 7, the cancellation collar 38 and the cancellation assist spring 39 are interposed between the tip end 34*b* of the spindle 34 and an inner wall of the spindle 34 in the axial direction, which is formed by the body 32 and the housing 33.

The cancellation collar 38 includes a columnar portion 38*a* and a cylindrical portion 38*b* from the side of the spindle 34. The columnar portion 38*a* and the cylindrical portion 38*b* are coaxially provided.

An end surface of the columnar portion 38*a*, which faces the spindle 34, is a plane 38*c* that perpendicularly intersects the axial direction of the spindle 34. In contrast, an end of the columnar portion 38*a* on the opposite side to the plane 38*c* is a flange 38*d* with a larger diameter than that of the main body of the columnar portion 38*a*. The outer diameter of the flange 38*d* is set to be slightly larger than the outer diameter of the cancellation assist spring 39 that is formed of a coil spring.

The cylindrical portion 38*b* continues to the flange 38*d*. The outer diameter of the cylindrical portion 38*b* is set to be slightly smaller than the inner diameter of the cancellation assist spring 39.

The cancellation assist spring 39 is interposed between the cancellation collar 38 and the inner wall of the spindle 34 in the axial direction, which is formed by the body 32 and the housing 33, in a state in which the end thereof on the side of the spindle 34 surrounds the outer circumference of the cylindrical portion 38*b* and is elastically pressurized. The cancellation assist spring 39 constantly biases the spindle 34 toward the side of the latch mechanism 2 via the cancellation collar 38. In addition, the cancellation collar 38 and the cancellation assist spring 39 correspond to the bias member.

As shown in FIG. 7, the swivel 41 includes a cylindrical portion 41*a*, a first connecting portion 41*b* that is provided at one end of the cylindrical portion 41*a*, and a second connecting portion 41*c* that is provided at the other end thereof. The first connecting portion 41*b* and the second connecting portion 41*c* are freely rotatable relative to the cylindrical portion 41*a*, respectively. Therefore, the first connecting portion 41*b* and the second connecting portion 41*c* are freely rotatable relative to each other. In addition, the first connecting portion 41*b* and the second connecting portion 41*c* respectively have ring-shaped portions to be connected to other configurations.

The first connecting portion 41*b* is connected to the end of the spindle 34 on the side of the latch mechanism 2. The second connecting portion 41*c* is connected to the wire 27 (see FIG. 3) via a first connector 43. The swivel 41 corresponds to the rotation absorption member.

The spherical first connector 43 is fixed to an end of the wire 27 on the opposite side to an end connected to the lever 28. A notch groove 43*a* that opens on the side of the spindle 34 is formed at a portion, which faces the spindle 34, of the first connector 43. The ring-shaped portion that forms the second connecting portion 41*c* of the swivel 41 can be inserted into the notch groove 43*a*. In addition, a cylindrical portion 43*b* that perpendicularly intersects the notch groove 43*a* is formed at the first connector 43. The first connector 43 and the second connecting portion 41*c* are connected to each other by inserting a pin 51 and swaging opposite ends of the pin 51 in a state in which the cylindrical portion 43*b* and the ring portion that forms the second connecting portion 41*c* match in the axial direction of the cylindrical portion 43*b*.

As shown in FIG. 5, the body 32 includes a semi-cylindrical portion 32*a* that extends on the side of the latch mechanism 2 beyond a semi-cylindrical accommodating portion for accommodating the spindle 34, the spindle guide 35, and the like. The housing 33 is not provided with a region corresponding to the semi-cylindrical portion 32*a*. Therefore, the semi-cylindrical portion 32*a* continues to the cylindrical inner space, which is formed by attaching the body 32 and the housing 33 to each other, on the side of the latch mechanism 2 in the axial direction as shown in FIG. 7. In addition, the semi-cylindrical portion 32*a* corresponds to the extending portion.

A semi-ring-shaped engagement projecting portion 32*c* is provided at a tip end of the semi-cylindrical portion 32*a* on the side of the inner circumference. The engagement projecting portion 32*c* corresponds to the supporting portion. The engagement projecting portion 32*c* can be engaged with a ring-shaped engagement groove 44*a* that is provided so as to be recessed in an outer circumferential surface of a cylindrical second connector 44 into which the wire 27 is inserted.

A first ring-shaped water-proof groove 45 is provided so as to be recessed in the engagement groove 44*a* of the second connector 44 on the side of the latch mechanism 2.

In addition, an annular region that is formed of a root of the semi-cylindrical portion 32*a* of the body 32, which continues by attaching the body 32 and the housing 33 to each other, and a tip end of the housing 33 on the side of the latch mechanism 2 is referred to as a ring-shaped portion 46. An outer diameter of the ring-shaped portion 46 is set to be larger than an outer diameter of the second connector 44. A second ring-shaped water-proof groove 47 is provided so as to be recessed in the ring-shaped portion 46.

The wire 27 is inserted into a cylindrical water-proof cap 48. The water-proof cap 48 is molded by using a resin material (for example, a transparent resin material). An inner diameter of the water-proof cap 48 on the side of the latch mechanism 2 is set to be equal to the outer diameter of the second connector 44. In addition, an inner diameter of the water-proof cap 48 on the opposite side to the latch mechanism 2 is set to be equal to the outer diameter of the ring-shaped portion 46 that is formed by attaching the body 32 and the housing 33 to each other.

The water-proof cap 48 is attached to the ring-shaped portion 46 that is formed by attaching the body 32 and the housing 33 to each other and the second connector 44 by being displaced from the side of the latch mechanism 2 to the side of the spindle 34 in a state in which the engagement projecting portion 32*c* of the semi-cylindrical portion 32*a* and the engagement groove 44*a* of the second connector 44 are engaged with each other. Here, O rings 49 and 50 that have larger diameters than those of the first water-proof groove 45 and the second water-proof groove 47, respectively are disposed. That is, the O ring 49 surrounds the circumference of the second connector 44, and the O ring 50 surrounds the circumference of the ring-shaped portion 46. In doing so, the O rings 49 and 50 are pressed by the water-proof cap 48 attached to the outer circumference of the second connector 44 and the ring-shaped portion 46 and suppress the entrance of liquid through the water-proof cap 48. Thus, the entrance of foreign matter including liquid to the inside of the body 32 and the housing 33 is suppressed.

As shown in FIG. 7, the cylindrical inner space that is formed by attaching the body 32 and the housing 33 to each other is sectioned to a space for accommodating the spindle guide 35 and a space for accommodating the worm wheel 40 by the reduced diameter portion 53. The inner diameter of the reduced diameter portion 53 is set to be smaller than the distance between the two projections 34*a* of the spindle 34. Therefore, the displacement of the spindle 34 toward the opposite side to the latch mechanism 2 is restricted by the projections 34*a* abutting the reduced diameter portion 53.

In addition, a bearing 55 is interposed between the wheel that forms the worm wheel 40 and the reduced diameter portion 53. The wheel is rotatably supported by the body 32 and the housing 33 via the bearing 55.

Operations

Next, a description will be given of operations of the door locking device 1. As an assumption of the following description, the closer device 3 is in a state in which the spindle 34 is located at the first axial position, the cancellation lever 36 is located at the first swing position, and the cancellation pole 37 is located at the rotation restriction position as shown in FIG. 6A.

First, a description will be given of a case in which the door locking device 1 is normally operated, that is, a case in which the inside door handle 12 and the outside door handle 13 (see FIG. 2) are not operated during an operation of the door locking device 1.

The control unit that controls the door locking device 1 detects that the latch mechanism 2 has been brought into the half-latched state (see FIG. 4B) in the state shown in FIG. 6A, and then drives the motor 31. Drive force of the motor 31 is transmitted to the spindle 34 via the worm wheel 40. At this time, the rotation of the spindle guide 35 is restricted. Therefore, the spindle 34 is displaced from the first axial position to the second axial position against the bias force of the cancellation assist spring 39 due to the drive force transmitted from the motor 31 as shown in FIG. 6B. The wire 27 is drawn to the side of the closer device 3 due to the displacement, the lever 28 is rotated and displaced in the clockwise direction from the initial position, and as a result, the latch mechanism 2 shifts from the half-latched state to the fully-latched state (see FIG. 4C), and the vehicle door 10 shifts from the half-shut state to the completely closed state.

The control unit that controls the door locking device 1 detects that the door locking device 1 has shifted to the fully-latched state and then stops the driving of the motor 31. In doing so, the drive force of the motor 31 does not act on the spindle 34, that is, only the bias force of the cancellation assist spring 39 acts on the spindle 34. Therefore, the spindle 34 is displaced from the second axial position to the first axial position. In doing so, the lever 28 is rotated and displaced in the counterclockwise direction and returns to the initial position. In addition, the latch mechanism 2 is maintained in the fully-latched state.

Next, a description will be given of a case in which the inside door handle 12 or the outside door handle 13 (see FIG. 2) is operated during the operation of the door locking device 1.

As shown in FIG. 6C, the cancellation lever 36 swings from the first swing position to the second swing position in response to an operation of the inside door handle 12 or the outside door handle 13. Therefore, the cancellation pole 37 is displaced from the rotation restriction position to the rotation permission position. In doing so, the abutting between the cancellation pole 37 and the spindle guide 35 is cancelled, and the rotation of the spindle guide 35 is then permitted.

Since the drive force of the motor 31 is transmitted as rotation to the spindle 34 via the worm wheel 40, the spindle 34 and the spindle guide 35 are rotated together if the rotation of the spindle guide 35 is permitted. Therefore, the force of causing displacement from the first axial position to the second axial position by the drive force of the motor 31 does not act on the spindle 34. That is, since only the bias force of the cancellation assist spring 39 acts on the spindle 34, the spindle 34 is displaced from the side of the second axial position to the first axial position as shown in FIG. 6D. Therefore, the force of causing rotation and displacement in the counterclockwise direction by the closer device 3 does not act on the latch 21 of the latch mechanism 2. That is, since only the force of causing rotation and displacement in the clockwise direction in response to an operation of the inside door handle 12 or the outside door handle 13 acts on the latch 21, the vehicle door 10 can be opened.

Since the spindle 34 is threadedly inserted into the wheel of the worm wheel 40, the spindle 34 causes rotation about the axial direction when the spindle 34 is displaced from the side of the second axial position to the first axial position by the bias force of the cancellation assist spring 39.

As described above in detail, the following effects can be achieved according to the embodiment.

(1) The closer device 3 is configured such that the latch mechanism 2 is driven by the displacement of the spindle 34, to which the drive force of the motor 31 is transmitted by the worm wheel 40, in the axial direction. It is possible to obtain a relatively higher deceleration ratio by the worm wheel 40 as compared with a planetary gear mechanism that is employed in the related art and to thereby employ a smaller-scaled motor 31 as compared with a motor employed in the related art. Therefore, it is possible to reduce the size of the closer device 3 and thus the size of the door locking device 1.

(2) The spindle guide 35 is provided with the substantially regular octagonal engagement portion 35*b*. In addition, the cancellation pole 37 is provided with the curved surface 37*a* that is in surface contact with the engagement portion 35*b*. The cancellation pole 37 restricts rotation of the spindle guide 35 by being brought into surface contact with the engagement portion 35*b* at the rotation restriction position and permits the rotation of the spindle guide 35 by being separated from the engagement portion 35*b* at the rotation permission position. As described above, it is possible to restrict the rotation of the spindle guide 35 by the surface contact, which is a simple configuration.

(3) The swivel 41 is used for connection between the spindle 34 and the wire 27. In doing so, the rotation of the spindle 34 is not transmitted to the wire 27. Since the rotation is not transmitted to the wire 27 that is formed of a twisted metal wire member, defects such as a defect that the wire member is untwisted and a defect that the wire member is twisted off do not easily occur in the wire 27.

(4) The outer diameter of the end of the spindle guide 35 on the side of the latch mechanism 2 is set to be smaller than the outer diameter of the end on the opposite side. In addition, the inner space that is formed by attaching the body 32 and the housing 33 to each other and corresponds to a portion for accommodating the spindle guide 35 is set such that the space on the side of the latch mechanism 2 is narrower than the space on the opposite side. In doing so, the insertion of the spindle guide 35 into the inner space in a state in which the axial direction of the spindle guide 35 is reversed is restricted. Therefore, erroneous assembly of the closer device 3 is suppressed.

(5) The water-proof cap 48 connects the second connector 44 into which the wire 27 is inserted and the ring-shaped portion 46 that is formed of the body 32 and the housing 33. In doing so, a state in which the connecting portion between the wire 27 and the spindle 34 is accommodated in the water-proof cap 48 is obtained. That is, since the ring-shaped portion 46 that serves as an opening of the inner space that is formed of the body 32 and the housing 33 is covered with the water-proof cap 48, the entrance of foreign matter to the inner space is suppressed. In doing so, the closer device 3 is preferably operated.

(6) The second connector 44 is supported by the semi-cylindrical portion 32*a* through the engagement between the engagement groove 44*a* and the engagement projecting portion 32*c*. In doing so, the second connector 44 is not displaced relative to the body 32 and the housing 33 when the water-proof cap 48 is attached to the second connector 44 and the ring-shaped portion 46. Therefore, the water-proof cap 48 can be easily attached.

(7) The water-proof cap 48 is attached to the second connector 44 and the ring-shaped portion 46 in a state in which the semi-cylindrical portion 32*a* is accommodated. In doing so, the second connector 44 has a structure of being supported at the body 32 and the housing 33 by both the semi-cylindrical portion 32*a* and the water-proof cap 48, and strength is secured.

(8) The water-proof cap 48 is attached to the second connector 44 and the ring-shaped portion 46 in a state in which the O rings 49 and 50, which have larger diameters than the depths of the first water-proof groove 45 and the second water-proof groove 47, are disposed at both the water-proof grooves. In doing so, the entrance of liquid through the water-proof cap 48 is suppressed. Thus, the entrance of foreign matter including liquid to the inside of the body 32 and the housing 33 is suppressed.

(9) The tip end of the spindle 34 on the side of the cancellation collar 38 is formed into a spherical shape, and the end surface of the cancellation collar 38 on the side of the spindle 34 is formed into a plane 38*c*. In doing so, the spindle 34 and the cancellation collar 38 are brought into point contact. Since the spindle 34 and the cancellation collar 38 are brought into point contact, frictional force caused between the spindle 34 and the cancellation collar 38 during the rotation of the spindle 34 becomes smaller than that in a case in which other shapes that result in another contact form are employed. Therefore, since attenuation of the bias force of the cancellation assist spring 39 due to the frictional force caused between the spindle 34 and the cancellation collar 38 is small when the spindle 34 is displaced from the side of the second axial position to the first axial position, it is possible to employ a small-scale spring as the cancellation assist spring 39. For this reason, it is possible to reduce the size of the closer device 3 and thus the size of the door locking device 1.

(10) The configuration is employed in which the cancellation assist spring 39 is disposed in the axial direction of the spindle 34 and the spindle 34 and the cancellation collar 38 abut on each other in the axial direction. In doing so, since a rotation moment by the bias force of the cancellation assist spring 39 is not easily input to the spindle 34, the occurrence of the frictional force due to contact between the spindle 34 and other members is suppressed.

(11) The spindle 34 is threadedly inserted into the wheel of the worm wheel 40. Therefore, the spindle 34 does not deviate from the axis even if the spindle 34 is rotated about the axial direction. Accordingly, the rotation moment due to the bias force of the cancellation assist spring 39 is not easily input to the spindle 34.

(12) The reduced diameter portion 53 that abuts the projections 34*a* for the purpose of restricting the displacement of the spindle 34 from the side of the first axial position to the side of the second axial position abuts on the bearing 55 on the side of the second axial position. That is, the reduced diameter portion 53 is pinched between the projections 34*a* and the bearing 55 when the reduced diameter portion 53 restricts the displacement of the spindle 34 from the side of the first axial position to the side of the second axial position. For this reason, the reduced diameter portion 53 is pressurized from both the pinching directions when the reduced diameter portion 53 restricts the displacement of the spindle 34. Therefore, the occurrence of defects at the reduced diameter portion 53 during the restriction is suppressed.

In addition, the aforementioned embodiment can be modified as follows.

Figure 9:
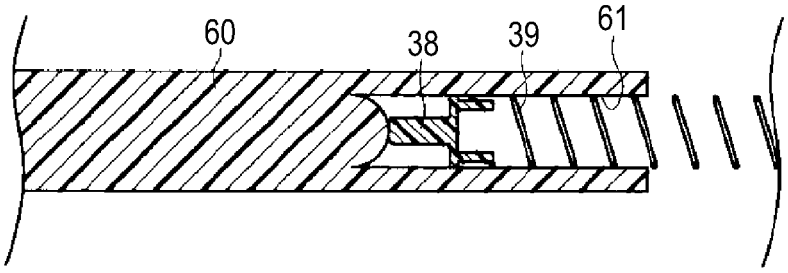
FIG. 9 is a sectional view of a closer device in another example.

A spindle 60 shown in FIG. 9 may be employed instead of the spindle 34 that is employed in the aforementioned embodiment. That is, the spindle 60 is provided with a tubular portion 61 that extends in the axial direction of the spindle 60 and opens on the opposite side to the latch mechanism 2 as shown in FIG. 9. In addition, a configuration is employed in which the cancellation collar 38 and the cancellation assist spring 39 are inserted into the tubular portion 61. With such a configuration, the length in the axial direction is reduced than that of the spindle 34 according to the aforementioned embodiment by the length corresponding to the insertion of the cancellation collar 38 and the cancellation assist spring 39 into the spindle 60 (tubular portion 61). Therefore, it is possible to reduce the size of the closer device 3 and thus the size of the door locking device 1.

Figure 10:
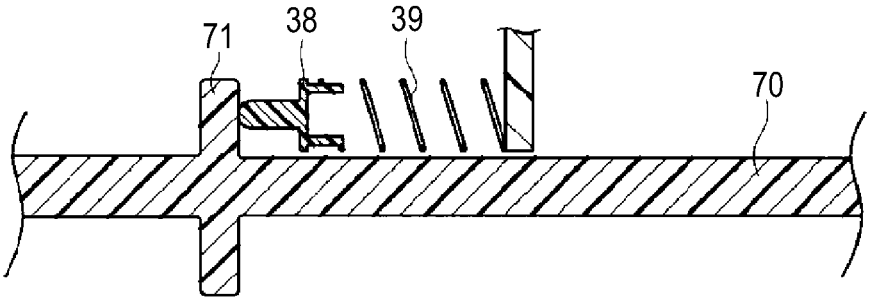
FIG. 10 is a sectional view of a closer device in another example.

A spindle 70 shown in FIG. 10 may be employed instead of the spindle 34 that is employed in the aforementioned embodiment. That is, the spindle 70 is provided with a disk-shaped flange portion 71, and the cancellation collar 38 and the cancellation assist spring 39 are disposed so as to pressurize the flange portion 71 as shown in FIG. 10. With such a configuration, the length in the axial direction is reduced than that of the spindle 34 according to the aforementioned embodiment as compared with a case in which the cancellation collar 38 and the cancellation assist spring 39 are disposed at the tip end of the spindle 34 as in the aforementioned embodiment. Therefore, it is possible to reduce the size of the closer device 3 and thus the size of the door locking device 1.

In a case of employing such a configuration, it is desirable that the tip end of the cancellation collar 38 is formed into a spherical shape. With such a configuration, the tip end of the cancellation collar 38 and the flange portion 71 are brought into point contact, and frictional force caused between the cancellation collar 38 and the flange portion 71 during rotation and displacement of the spindle 70 about the axial direction can be reduced.

Although the tip end of the spindle 34 on the side of the cancellation collar 38 is formed into the spherical shape and the end surface of the tip end of the cancellation collar 38 on the side of the spindle 34 is formed into the plane in the aforementioned embodiment, the relationship may be reversed.

In the aforementioned embodiment, various kinds of wiring may not be inserted into the case 23 of the latch mechanism 2. In such a case, the connector portion 29 may be omitted.

In the aforementioned embodiment, the closer device 3 may be employed not only for the latch mechanism 2 for the swing-type vehicle door 10 but also as a closer device 3 for a sliding-type door.

Although the engagement portion 35*b* has a substantially regular octagonal shape in the aforementioned embodiment, any shape is also applicable as long as the shape is a regular polygonal shape. Although the engagement portion 35*b* has the curved surfaces, the surfaces are not necessarily curved surfaces. In a case of employing planes instead of curved surfaces for the engagement portion 35*b*, corresponding plane is also employed instead of the curved surface 37*a* for the cancellation pole 37.

Although the wire 27 is employed as the transmission member in the aforementioned embodiment, any member is applicable as long as the member has a string shape. In addition, a straight rod member may also be employed depending on a positional relationship between the latch mechanism 2 and the closer device 3.

In the aforementioned embodiment, a spindle guide 35 with a uniform outer shape may be employed.

In the aforementioned embodiment, the rotation absorption member is not limited to the swivel 41. For example, a ball joint may be employed.

Although the spindle 34 is threadedly inserted into the wheel that forms the worm wheel 40 in the aforementioned embodiment, a configuration is also applicable in which the spindle 34 is directly threaded to the worm.

Although the O rings 49 and 50 are employed as the sealing members in the aforementioned embodiment, other sealing members may be used as long as the sealing members suppress entrance of foreign matters. In addition, the O rings 49 and 50 may be omitted.

In the aforementioned embodiment, the spindle guide 35 may be omitted. In such a case, the body 32 or the housing 33 is provided with a configuration corresponding to the guide groove 35*a*, and the spindle 34 is guided by the configuration corresponding to the guide groove 35*a*. In a case of employing such a configuration, the cancellation pole 37 may be provided so as to be displaced between a position at which the cancellation pole 37 abuts on the spindle 34 and restricts the displacement of the spindle 34 and a position at which the cancellation pole 37 is separated from the spindle 34 and permits the displacement of the spindle 34.

A closer device according to an aspect of this disclosure includes: a threaded shaft that rotates by drive force of a motor; a shaft-like member that threadedly engages with the threaded shaft to transmit decelerated rotation of the threaded shaft and permit displacement in an axial direction between a first axial position and a second axial position; and a restriction member that is displaced between a first position at which the shaft-like member is displaced from the side of the first axial position to the side of the second axial position by restricting rotation of the shaft-like member that accompanies the rotation of the threaded shaft and a second position at which the displacement of the shaft-like member from the side of the first axial position to the side of the second axial position is restricted by permitting the rotation of the shaft-like member that accompanies the rotation of the threaded shaft, in which the shaft-like member drives a locking member of a latch mechanism by being displaced from the first axial position to the second axial position, and in which the restriction member is displaced from the first position to the second position in conjunction with an operation unit that is operated by a user.

According to this configuration, the shaft-like member by which the rotation of the motor is decelerated and then transmitted due to the threaded engagement is employed, and the locking member of the latch mechanism is driven by the displacement of the shaft-like member in the axial direction. For this reason, the closer device is reduced in size as compared with a closer device that employs a planetary gear mechanism as a deceleration mechanism as in the related art.

In the configuration, it is preferable that the closer device further includes a tubular member, into which the shaft-like member is inserted, which is integrally rotated with the shaft-like member, that at least a part of an outer circumferential surface of the tubular member is formed into a polygonal shape with corners, and that the restriction member includes an engagement surface that is in surface contact with a surface having the polygonal shape.

According to this configuration, it is possible to easily restrict the rotation of the tubular member by surface contact, which is a simple configuration.

In the configuration, it is preferable that the shaft-like member is connected to the latch mechanism via a rotation absorption member that absorbs the rotation of the shaft-like member and a transmission member that transmits the displacement of the shaft-like member in the axial direction.

According to this configuration, since the rotation of the shaft-like member is not transmitted to the transmission member, defects in the transmission member and the latch mechanism are suppressed during the displacement of the shaft-like member in the axial direction.

In the configuration, it is preferable that the rotation absorption member is a swivel.

According to this configuration, defects in the transmission member and the latch mechanism are suppressed by employing a simple configuration of the swivel.

In the configuration, it is preferable that a space that accommodates the tubular member is formed to have different sizes in an axial direction thereof and that an outer shape of the tubular member is set to have different sizes on one end side and the other end side.

With such a configuration, erroneous assembly of the tubular member is suppressed.

A vehicle door locking device according to another aspect of this disclosure is preferably provided with the closer device according to any one of the above descriptions.

The closer device and the vehicle door locking device according to the aspects of this disclosure are small in size.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A closer device comprising:

a threaded shaft that rotates by drive force of a motor;

an elongated member that threadedly engages with the threaded shaft to transmit decelerated rotation of the threaded shaft and permit displacement in an axial direction between a first axial position and a second axial position;

a tubular member in which the elongated member is positioned, the tubular member and the elongated member being integrally rotatable with one another;

a restriction member that is displaced between a first position at which the elongated member is displaced from the side of the first axial position to the side of the second axial position by restricting rotation of the elongated member that accompanies the rotation of the threaded shaft and a second position at which the displacement of the elongated member from the side of the first axial position to the side of the second axial position is restricted by permitting the rotation of the elongated member that accompanies the rotation of the threaded shaft;

wherein the elongated member drives a locking member of a latch mechanism by being displaced from the first axial position to the second axial position; and wherein the restriction member is displaced from the first position to the second position in conjunction with an operation unit that is operated by a user.

2. The closer device according to claim 1, wherein at least a part of an outer circumferential surface of the tubular member is formed into a polygonal shape with corners, and wherein the restriction member includes an engagement surface that is in surface contact with a surface having the polygonal shape.

3. The closer device according to claim 2, wherein a space that accommodates the tubular member is formed to have different sizes in an axial direction thereof, and wherein an outer shape of the tubular member is set to have different sizes on one end side and the other end side.

4. The closer device according to claim 1, wherein the elongated member is connected to the latch mechanism via a rotation absorption member that absorbs the rotation of the elongated member and a transmission member that transmits the displacement of the elongated member in the axial direction.

5. The closer device according to claim 4, wherein the rotation absorption member is a swivel.

6. The closer device according to claim 1, further comprising:

a case that accommodates the elongated member and has an opening that permits the displacement of the elongated member in the axial direction;

a transmission member that connects the elongated member and the latch mechanism;

a connector into which the transmission member is inserted; and a cap that connects the opening and the connector in a state of accommodating a connecting portion between the transmission member and the elongated member.

7. The closer device according to claim 6, wherein the case has an extending portion that extends in the axial direction of the elongated member from the opening, and wherein the connector has a support portion that is supported by the extending portion.

8. The closer device according to claim 7, wherein the cap connects the opening and the connector in a state of accommodating the extending portion.

9. The closer device according to claim 6, further comprising:

a sealing member that surrounds the connector, wherein the cap is attached to the connector with the sealing member interposed therebetween.

10. The closer device according to claim 6, further comprising:

a sealing member that surrounds the circumference of the opening, wherein the cap is attached to the opening with the sealing member interposed therebetween.

11. The closer device according to claim 1, further comprising:

a bias member that abuts on the elongated member and biases the elongated member from the side of the second axial position to the side of the first axial position, wherein the elongated member drives the latch mechanism by being displaced from the first axial position to the second axial position, and wherein one of abutting regions that is formed into a spherical shape is formed in a region, which abuts on the bias member, of the elongated member, and the other of the abutting regions that is formed into a plane is formed in a region, which abuts on the elongated member, of the bias member.

12. The closer device according to claim 11, wherein the elongated member and the bias member are in contact with each other in the axial direction of the elongated member.

13. The closer device according to claim 12, wherein a region, which abuts on the bias member, of the elongated member is formed into a spherical shape, and a region, which abuts on the elongated member, of the bias member is formed into a plane.

14. The closer device according claim 12, wherein the elongated member has a tubular portion that extends in a coaxial direction with the axial direction of the elongated member, and wherein the bias member biases the elongated member in a state of being inserted into the tubular portion.

15. The closer device according to claim 12, wherein the elongated member has a flange portion that projects in a radial direction, and wherein the bias member biases the elongated member through abutting with the flange portion.

16. A vehicle door locking device comprising the closer device according to claim 1.

17. A closer device comprising:

a shaft that rotates by drive force of a motor, the shaft including a threaded portion;

a rotatable and axially displaceable elongated member including a threaded portion that is in direct threaded engagement with the threaded portion of the shaft to transmit decelerated rotation of the shaft when rotation of the elongated member is permitted and to move axially in an axial direction between a first axial position and a second axial position when rotation of the elongated member is restricted;

a restriction member that is movable between a first position at which the restriction member restricts rotation of the elongated member so that the elongated member is displaced from the first axial position to the second axial position by restricting rotation of the elongated member during the rotation of the shaft and a second position at which the restriction member permits the rotation of the elongated member during the rotation of the shaft;

the elongated member driving a locking member of a latch mechanism by being displaced from the first axial position to the second axial position; and wherein the restriction member is displaced from the first position to the second position by operation of an operation unit that is operated by a user.

* * * * *